US008272968B2

(12) United States Patent
Morris

(10) Patent No.: US 8,272,968 B2
(45) Date of Patent: Sep. 25, 2012

(54) ELECTRONIC LASER LIGHTED POOL GAME SYSTEM

(76) Inventor: Michael Morris, Bellwood, IL (US)

( * ) Notice: Subject to any disclaimer, the term of this patent is extended or adjusted under 35 U.S.C. 154(b) by 6 days.

(21) Appl. No.: 12/883,173

(22) Filed: Sep. 15, 2010

(65) Prior Publication Data

US 2011/0065520 A1 Mar. 17, 2011

Related U.S. Application Data

(60) Provisional application No. 61/242,709, filed on Sep. 15, 2009.

(51) Int. Cl.
*A63D 15/00* (2006.01)
*A63D 15/08* (2006.01)

(52) U.S. Cl. ..... 473/2; 473/44

(58) Field of Classification Search ..... 473/2, 1, 473/44, 28; 273/309
See application file for complete search history.

(56) References Cited

U.S. PATENT DOCUMENTS

| | | | | |
|---|---|---|---|---|
| 1,163,412 | A * | 12/1915 | Jorstad | 473/28 |
| 4,688,796 | A * | 8/1987 | Wright | 473/2 |
| 5,026,053 | A | 6/1991 | Paterson | |
| 5,275,398 | A * | 1/1994 | Compton | 473/2 |
| 5,470,765 | A * | 11/1995 | Stiefvater | 473/28 |
| 5,791,758 | A * | 8/1998 | Horgan et al. | 362/554 |
| 5,941,778 | A | 8/1999 | Vasalech | |
| 6,117,019 | A * | 9/2000 | Taylor | 473/46 |
| 6,155,929 | A * | 12/2000 | Chipman | 473/2 |
| 6,371,860 | B1 * | 4/2002 | Anderson | 473/1 |
| 6,854,728 | B2 * | 2/2005 | Oister et al. | 273/108.1 |
| 7,063,620 | B2 * | 6/2006 | Nearhood | 473/2 |
| 7,335,111 | B2 * | 2/2008 | Deakes | 473/44 |
| 7,611,417 | B2 * | 11/2009 | Murrey et al. | 473/4 |
| 2004/0067796 | A1 | 4/2004 | Murrey et al. | |
| 2004/0070149 | A1 * | 4/2004 | Lipscomb et al. | 273/309 |
| 2006/0247068 | A1 | 11/2006 | Lagaipa | |
| 2007/0219007 | A1 | 9/2007 | Giroux | |
| 2009/0131186 | A1 | 5/2009 | Martin et al. | |

FOREIGN PATENT DOCUMENTS

| | | | |
|---|---|---|---|
| CN | 201308762 | Y | 9/2009 |
| GB | 002232606 | A | 12/1990 |
| JP | 411104290 | A | 4/1999 |
| JP | 02000084140 | A | 3/2000 |
| RU | 2365399 | C1 | 8/2009 |
| WO | WO 9847586 | A1 * | 10/1998 |

* cited by examiner

*Primary Examiner* — Mitra Aryanpour
(74) *Attorney, Agent, or Firm* — Thien Tran, Esq.; Access Patent Group, LLC.

(57) ABSTRACT

A pool game system includes a pool table having a playing surface, rails and pockets, pool balls and at least one cue stick. A plurality of illuminating components are within the rails of the pool table. A plurality of contact sensors are each within the rails and pockets of the pool table. A computer within the pool table causes one illuminating component to flash when one contact sensor detects one pool ball propelled by the at least one cue stick, when in a first instance the pool ball bounces off a rail and when in a second instance the pool ball enters a pocket of the pool table.

7 Claims, 4 Drawing Sheets

ELECTRONIC LASER LIGHTED POOL GAME SYSTEM

CROSS-REFERENCE TO RELATED APPLICATION

This application claims the benefit of Provisional Patent Application No. 61/242,709, filed on Sep. 15, 2009, in the United States Patent & Trademark Office, the disclosure of which is incorporated herein by reference.

BACKGROUND OF THE INVENTION

1. Field of the Invention

The present invention relates to a pool table, and more particularly, a pool game system.

The present invention allows pool players to not only keep score electronically, but also includes cue sticks with built-in red laser beams to identify clear paths to pockets on a pool table. The pool game system can assist pool players in playing a friendly or competitive game of pool on the pool table with lights, sensors and other features that will increase one's enjoyment during the play of the game. The present invention can be utilized in both private residences as well as commercial establishments. Due to the feature of storing past games, the pool game system is ideal for use during tournaments.

2. Description of the Prior Art

Standard pool tables may look alike. These items may have no way to keep score for players. Writing down scores and figuring out totals may be time consuming and aggravating and may also hold up the play of the game. Many players wish for a more modern pool table with various features to assist them in keeping score, holding previous game stats and the like.

Numerous innovations for parlor games have been provided in the prior art that will be described. Even though these innovations may be suitable for the specific individual purposes to which they address, however, they differ from the present invention.

A FIRST EXAMPLE, U.S. Pat. No. 5,026,053, Issued on Jun. 25, 1991, to Paterson et al. teaches a table game device and method having a playing surface and electronic display. A plurality of pocket openings, numbering six or other number, as in a standard six pocket billiard table, with individual switching and signal generating means are provided. Switching or signal generating means generate signals to be processed by electronic computer control means. Each pocket opening is assigned a different game or sport play action at specified intervals such as after each play on the table surface. Scoreboard display has a lighted animated display showing a field, arena or playing environment for the game or sport selected and being played. Advertising and promotional materials may be shown on the displayer between plays and games.

A SECOND EXAMPLE, U.S. Pat. No. 5,941,778, Issued on Aug. 28, 2001, to Malavazos et al. teaches a luminescent billiard game system providing an interesting and fun variation of the game which allows the game to be played in limited lighting conditions. The system comprises a billiard table having a number of luminescent surfaces which indicate the table perimeter edges, pocket locations, starting lines, distance indicators, and center point of the table. Additionally, cue stick tips are provided with luminescent material along with the billiard balls. A cabinet is also provided for charging the cue sticks and balls with concentrated light, for billiard tables not equipped with automatic ball returns, the light is activated upon closure of the cabinet and includes highly reflective interior surfaces. A ball bin charging light is also provided for charging balls on billiard tables equipped with automatic ball returns, while the charging light is also utilized to transmit light, optic fibers, to desired locations on the billiard table.

A THIRD EXAMPLE, U.S. Patent Office Publication No. 2004/0067796, Published on Apr. 8, 2004, to Murrey et al. teaches a game table, such as a billiards table, with lights. Preferred embodiments and features provide for lights mounted around the periphery of a game table or mounted on the sides of a game table. The lights may be internally or externally powered from the table. Certain preferred embodiments provide one or more power sources mounted to the game table to power the lights. Other preferred embodiments provide one or more solar panels to recharge the power source(s) mounted to the game table. In some preferred embodiments, the game table includes indirect lighting, such as downward or outward facing lights mounted on the sides or apron of a billiards table. In an alternate preferred embodiment, rope lights are mounted around the periphery of a table.

A FOURTH EXAMPLE, U.S. Patent Office Publication No. 2006/0247068, Published on Nov. 2, 2006, to Lapaipa teaches a light emitting cue which comprises an elongated tapered rod, a contact member and a laser device. The elongated tapered rod has a substantially straight longitudinal axis. The contact member is attached to a cue ball engaging end of the elongated tapered rod. The laser device is mounted within the elongated tapered rod. The laser device generates and directs a beam of light from within the elongated tapered rod through a passage in the contact member.

A FIFTH EXAMPLE, U.S. Patent Office Publication No. 2007/0219007, Published on Sep. 20, 2007, to Giroux teaches a pool table which comprises a planar playing surface and having conventional indent sidewalls and pockets associated therewith, the improvement wherein there is provided a center cushion which is located substantially centrally of the playing surface. Preferably, the center cushion partially surrounds a centrally located pocket A SIXTH EXAMPLE, U.S. Patent Office Publication No. 2009/0131186, Published on May 21, 2009, to Martin et al. teaches a method for play of a parlor entertainment unit including a remote activation assembly and an activation-sensing unit. The activation-sensing unit, which may be battery operated and housed in the entertainment unit, may be in an energy-conserving sleep mode until the activation-sensing unit receives a wake-up signal. In one embodiment, the wake-up signal may be generated by the engagement of an activation mechanism, such as a coin slide. After being awoken, the activation-sensing unit may transmit an inquiry to the remote activation assembly as to whether the associated entertainment unit has been selected for play and/or whether there are a sufficient number of credits available for play. If that entertainment unit has not been selected for play, the activation-sensing unit may return to a sleep mode. However, if sufficient play credits are available for the entertainment unit, play may commence.

It is apparent now that numerous innovations for parlor games have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a pool game system that avoids the disadvantages of the prior art.

ANOTHER OBJECT of the present invention is to provide a pool game system that is simple and inexpensive to manufacture.

STILL ANOTHER OBJECT of the present invention is to provide a pool game system that is simple to use.

BRIEFLY STATED, STILL YET ANOTHER OBJECT of the present invention is to provide a pool game system comprising a pool table having a playing surface, rails and pockets. A plurality of pool balls and at least one cue stick are provided. A plurality of illuminating components is within the rails of the pool table. A plurality of contact sensors are each within the rails and pockets of the pool table. A computer within the pool table causes one illuminating component to flash when one contact sensor detects one pool ball propelled by the at least one cue stick, when in a first instance the pool ball bounces off a rail and when in a second instance the pool ball enters a pocket of the pool table.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

Figure 1:
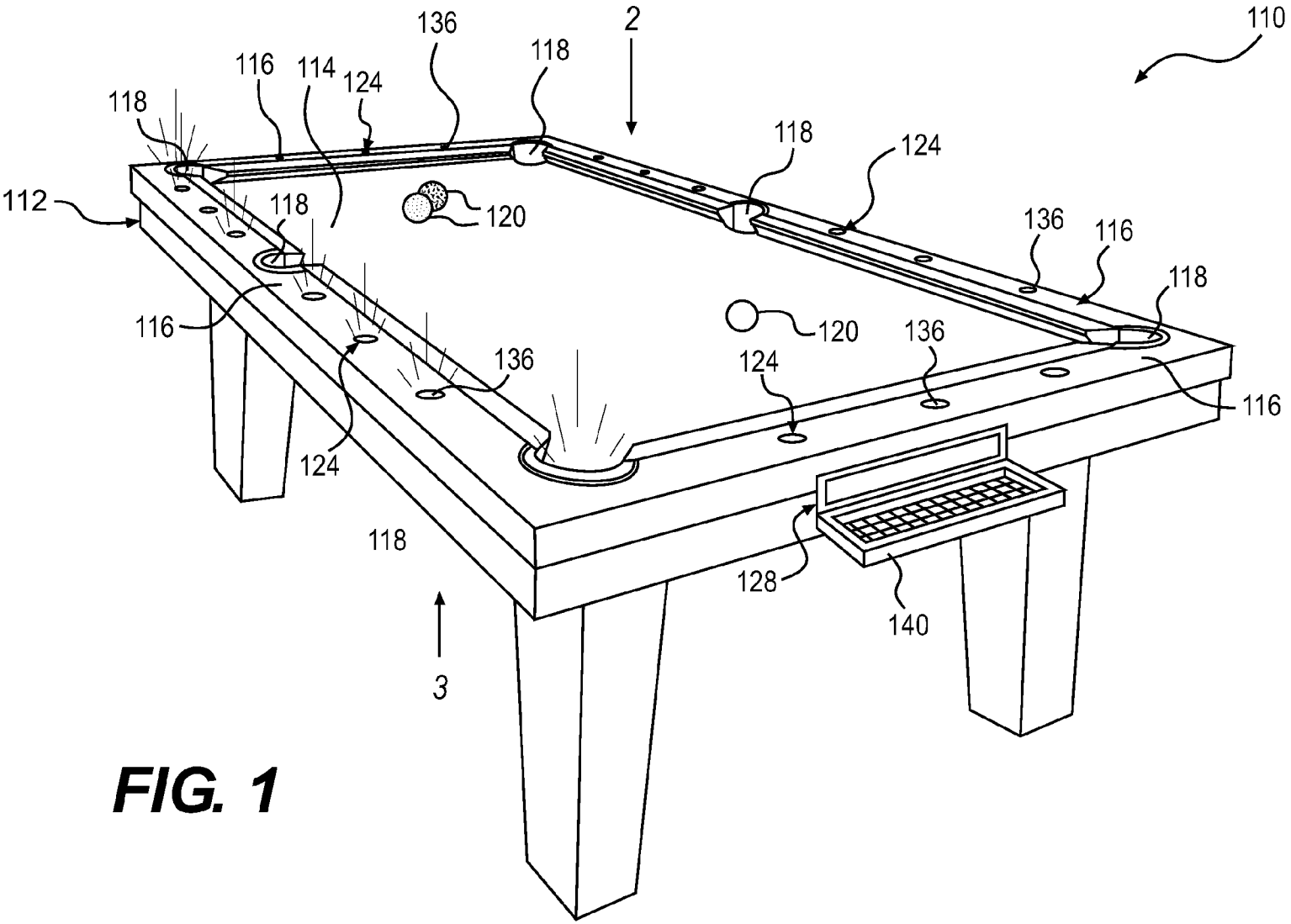
FIG. 1 is a perspective view of the present invention.

110 pool game system
112 pool table of pool game system 110
114 playing surface of pool table 112
116 rail of pool table 112
118 pocket of pool table 112
120 pool ball of pool game system 110
122 cue stick of pool game system 110
124 illuminating component of pool game system 110
126 contact sensors of pool game system 110
127 wiring system from computer 128 to each contact sensors 126
128 computer of pool game system 110
130 light emitting element in forward end of cue stick 132
132 forward end of cue stick 122
134 red laser beam from light emitting element 130
135 path of pool ball 120
136 light emitting diode for illuminating component 124
138 micro switch for contact sensor 126
140 data input keyboard of computer 128
150 battery
152 switch circuitry
154 laser LED

DETAILED DESCRIPTION OF THE PREFERRED EMBODIMENT

Referring now to the figures, in which like numerals indicate like parts, and particularly to FIGS. 1 through 4, and as such, will be discussed with reference thereto.

The present invention is a pool game system 110 comprising a pool table 112 having a playing surface 114, rails 116 and pockets 118. A plurality of pool balls 120 and at least one cue stick 122 are provided. A plurality of illuminating components 124 are within the rails 116 of the pool table 112. A plurality of contact sensors 126 are each within the rails 116 and pockets 118 of the pool table 112. A computer 128 within the pool table 112 causes one illuminating component 124 to flash when one contact sensor 126 detects one pool ball 120 propelled by the at least one cue stick 122, when in a first instance the pool ball 120 bounces off a rail 116 and when in a second instance the pool ball 120 enters a pocket 118 of the pool table 112. The computer 128 can also control (via an interface) the light patterns of the illuminating components 124 (LEDs) such as sequential lighting, sequential flashing, and intermittent flashing.

Figure 2:
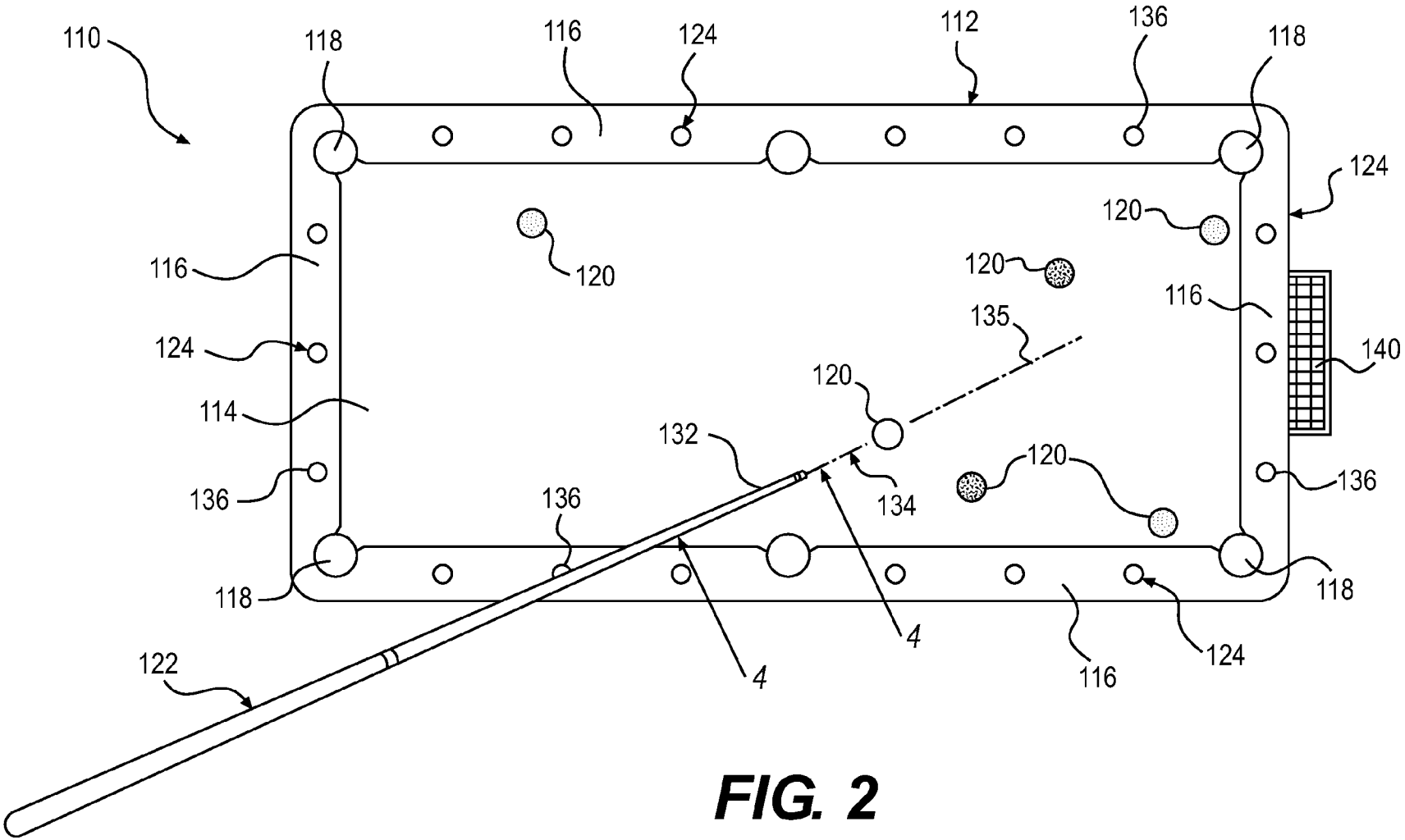
FIG. 2 is a top view taken in the direction of arrow 2 in FIG. 1, showing the cue stick in use.
Figure 3:
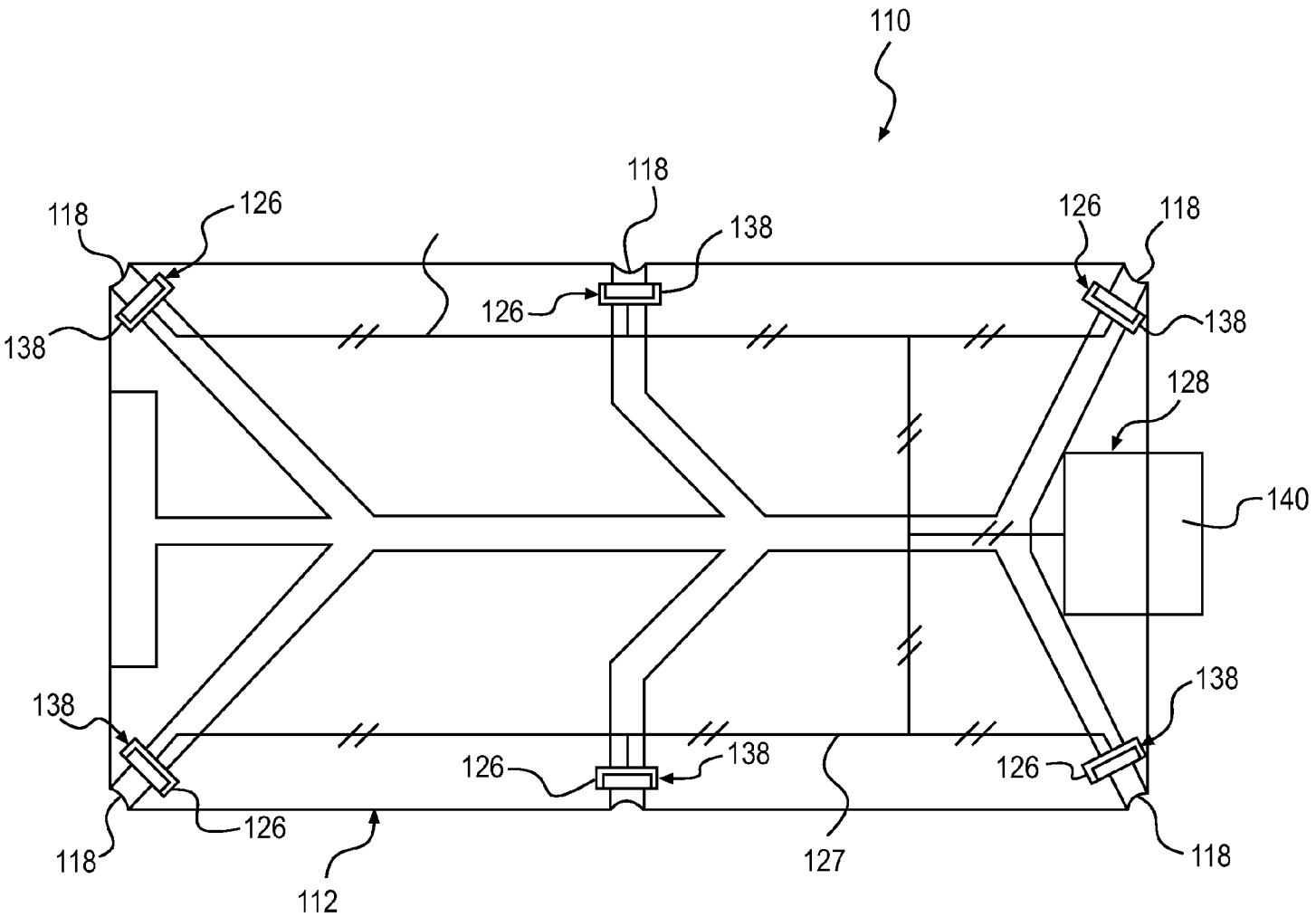
FIG. 3 is a diagrammatic bottom view taken in the direction of arrow 3 in FIG. 1.
Figure 4:
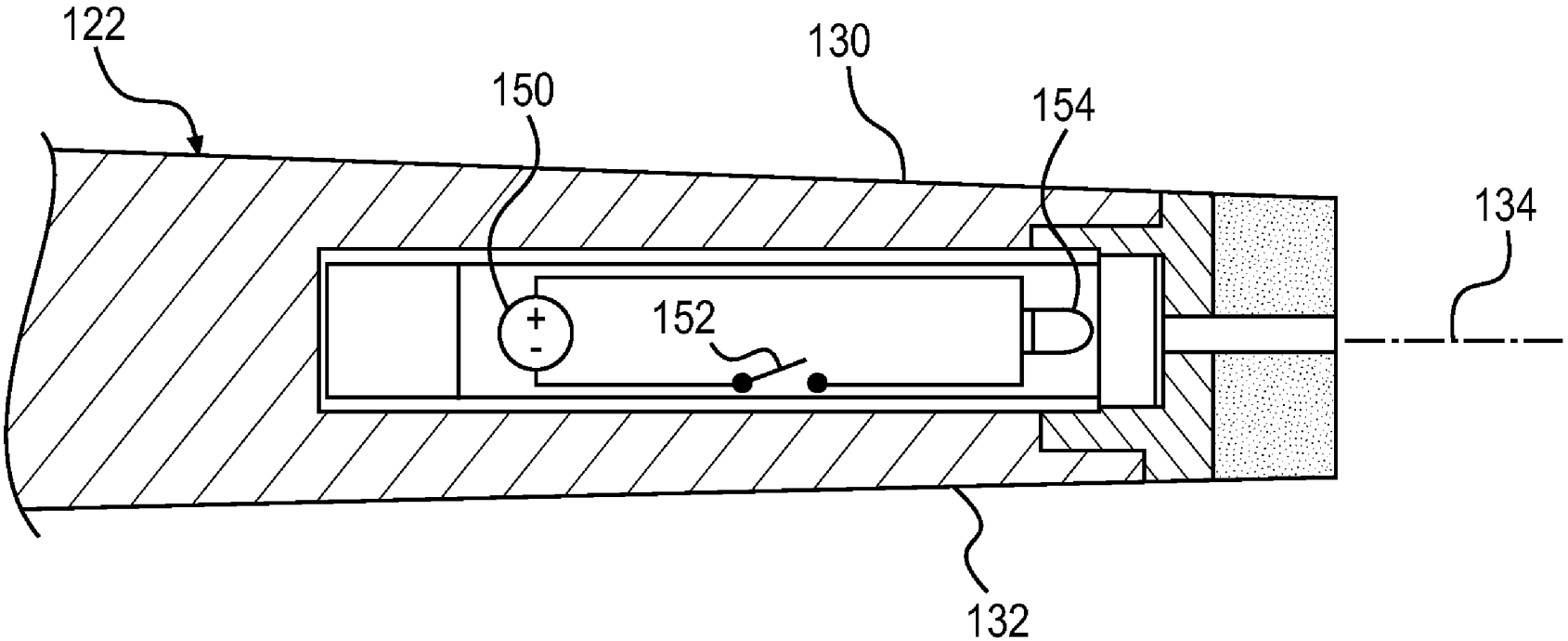
FIG. 4 is an enlarged cross sectional view taken along line 4-4 in FIG. 2.

The cue stick 122, as shown in FIGS. 2 and 4, comprises a built-in light emitting element 130 in a forward end 132, to produce a red laser beam 134 for identifying or pointing a path 135 to a specific pocket 118 on the playing surface 114 of the pool table 112. Each illuminating component 124 is comprised out of a light emitting diode 136.

Each contact sensor 126 is comprised out of a normally open micro switch 138, which will close when one pool ball 120 in a first instance makes contact with a rail 116 and in a second instance falls into a pocket 118 of the pool table 112. The computer 128 further comprises a data input keyboard 140 used to store and save game data, scores and other information within the computer 128.

The pool game system 110 offers players a new way to play pool with the pool table 112 having the ability to light up during the play of the game. The present invention is the same size and shape as a standard pool table 112. The outer edge of the pool table 112 may be wood. The rails 116 may be clear acrylic with the top having a layer of red felt. The pockets 118 and the rails 116 have the contact sensors 126 to activate the illuminating components 124. If a pool ball 120 bounces off one of the rails, a light emitting diode 136 will flash. If a pool ball 120 enters a pocket 118, that particular pocket 118 will also activate a light emitting diode 136. The light emitting diodes 136 may be in various color combinations. The computer 128 built-in one of the rails 116 allows the players to enter their names on the data input keyboard 140. A wiring system 127 is connected from computer 128 to each contact sensors 126. The computer 128 stores and saves game data, scores and other information. The data input keyboard 140 of the computer 128 can be pulled out for easy access, making it user friendly and ergonomically fit so as not to cause stress in bending over to input the data. In FIG. 4, a cue stick(s) 122 used in conjunction with the pool table 112 have a red laser beam 134 extending from a forward end 132 to identify paths to specific pockets 118 (the laser beam 134 goes out via a crossed hair slot). The cue stick forward end 132 includes a battery 150, a laser LED 154, and a switch circuitry 152. The switch circuitry 152 can control the laser beam 134 in two modes: strobing/flashing and non-strobing. The battery 150 can be 1.5, 3.0, 4.5 and 6.0 volts.

The exact dimensions, materials used for construction and method of operation of the pool game assembly 110 may vary upon manufacturing.

It will be understood that each of the elements described above, or two or more together, may also find a useful application in other types of constructions differing from the types described above.

While the invention has been illustrated and described as embodiments of a pool game system, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An electronic laser lighted pool game system comprising:

a) a pool table having a playing surface, a plurality of rails and a plurality of pockets;

b) a plurality of illuminating components placed within the plurality of rails;

c) a plurality of contact sensors positioned within the plurality of rails and plurality of pockets d) a computer placed within an end of the pool table for controlling the plurality of illuminating components;

e) a plurality of pool balls placed on the playing surface; and f) at least one cue stick for impacting and propelling the plurality of pool balls across the playing surface;

wherein when the at least one cue stick propels one of the plurality of pool balls across the playing surface;

wherein when the at least one cue stick propels one of the plurality of pool balls across the playing surface; the computer causes the plurality of illuminating components to flash in response to the plurality of contact sensors detecting:

a) the plurality of pool balls impacting the plurality of rails; and b) the plurality of pool balls entering any one of the plurality of pockets.

2. The pool game system as recited in claim 1, wherein at least one cue stick comprises a battery, a control switch circuit, a cross-hair slot and a built-in light emitting element placed within in a forward end of the at least one cue stick, upon activation of the at least one cue stick, a red laser beam is formed for identifying a path to a preselect one of the plurality of pockets.

3. The pool game system as recited in claim 1, wherein the plurality of illuminating components is comprised of light emitting diode.

4. The pool game system as recited in claim 1, wherein the plurality of contact sensor is comprised of a micro switch, The micro switch is in a closed position when:

a) one of the plurality of pool balls contacts one of the plurality of rails; and b) one of the plurality of pool balls is pocketed.

5. The pool game system as recited in claim 1, wherein said computer further comprises a data input keyboard used for storing and saving game data, scoring data and.

6. The pool game system as recited in claim 1, wherein the computer controls the light patterns of the plurality of illuminating components such as sequential lighting, sequential flashing, and intermittent flashing.

7. The pool game system as recited in claim 2, wherein the control switch circuit controls the laser beam in one of two modes;

a) strobing/flashing, and b) non-strobing.

* * * * *